US008739454B2

(12) United States Patent
Erdle et al.

(10) Patent No.: US 8,739,454 B2
(45) Date of Patent: Jun. 3, 2014

(54) GUN SIGHT WITH RANGE FINDER

(71) Applicant: Dead Ringer, LLC, Rochester, NY (US)

(72) Inventors: Jesse Erdle, Rochester, NY (US); Mike Furla, Rochester, NY (US); Kristian Meyer, Rochester, NY (US)

(73) Assignee: Dead Ringer, LLC, Rochester, NY (US)

( * ) Notice: Subject to any disclaimer, the term of this patent is extended or adjusted under 35 U.S.C. 154(b) by 0 days.

(21) Appl. No.: 13/665,309

(22) Filed: Oct. 31, 2012

(65) Prior Publication Data

US 2013/0263492 A1 Oct. 10, 2013

Related U.S. Application Data

(60) Provisional application No. 61/620,601, filed on Apr. 5, 2012.

(51) Int. Cl.
*F41G 1/32* (2006.01)

(52) U.S. Cl.
USPC ..... 42/145; 42/144

(58) Field of Classification Search
USPC ..... 42/144, 145, 111, 123, 130, 131, 132, 42/141, 142
See application file for complete search history.

(56) References Cited

U.S. PATENT DOCUMENTS

| | | | | | |
|---|---|---|---|---|---|
| 2,161,303 | A * | 6/1939 | Loomis | 42/130 |
| 2,353,133 | A * | 7/1944 | Gorman | 42/130 |
| 2,430,469 | A * | 11/1947 | Karnes | 42/145 |
| 2,970,380 | A * | 2/1961 | Hill | 42/141 |
| 3,499,224 | A * | 3/1970 | Jenny et al. | 42/140 |
| 4,734,990 | A * | 4/1988 | Sanders | 42/137 |
| 4,920,654 | A * | 5/1990 | Sanders | 42/137 |
| 6,032,374 | A * | 3/2000 | Sammut | 42/122 |
| 6,678,987 | B2 * | 1/2004 | Howe | 42/132 |
| 6,684,551 | B2 * | 2/2004 | Howe | 42/132 |
| 6,860,056 | B2 * | 3/2005 | Howe | 42/132 |
| 7,856,750 | B2 * | 12/2010 | Sammut et al. | 42/122 |
| 8,109,029 | B1 * | 2/2012 | Sammut et al. | 42/122 |
| 8,230,635 | B2 * | 7/2012 | Sammut et al. | 42/122 |
| 8,286,383 | B2 * | 10/2012 | Matthews | 42/122 |
| 2003/0121196 | A1 * | 7/2003 | Howe | 42/132 |
| 2003/0121197 | A1 * | 7/2003 | Howe | 42/132 |
| 2004/0025398 | A1 * | 2/2004 | Howe | 42/132 |
| 2009/0049733 | A1 * | 2/2009 | Matthews | 42/122 |

* cited by examiner

*Primary Examiner* — Jonathan C Weber
(74) *Attorney, Agent, or Firm* — Hiscock & Barclay, LLP

(57) ABSTRACT

Handgun front sight 140 has an elongated, rectangular body with a light pipe 21 inserted into the open space between the rear opening 141 and forward opening 142. The base of the front sight is slanted to raise the proximate end relative to the distal end. The rear sight 120 has a body 102 with a circular opening for centering the target. A compass ring 60 fits inside the circular opening. A pair of light pipes 116*a*, 116*b* in the body of the rear sight are aligned with 90 and 270 degree points of the compass ring to establish an imaginary line across the diameter. The front light pipe is centered along that imaginary line.

17 Claims, 8 Drawing Sheets

GUN SIGHT WITH RANGE FINDER

CROSS-REFERENCE TO RELATED APPLICATIONS

This application claims priority to U.S. Provisional Application Ser. No. 61/620,601 filed Apr. 5, 2012, the specification of which is hereby incorporated by reference in its entirety.

BACKGROUND

This invention relates to gun sights for firearms and more particularly to a gun sight for acquiring and hitting moving targets, whether the moving targets are artificial, such as clay disks hurled by trapshooting machines, game birds, or assailants.

Sights for firearms typically comprise front and rear aiming pieces that are aligned and pointed at a target. Such sights can be found on many types of firearms including shotguns, rifles and handguns. These sights are usually formed of rugged metal parts and are frequently referred to as "iron sights", in order to distinguish them from other complex weapon sights such as optical or computing sights. Firearms are manufactured with original equipment iron sights, but such sights may be replaced with one or more varieties of aftermarket iron sights. Iron sights also are classified in forms of notch (open sight) or aperture (closed sight). Such types of sights often require considerable experience and skill in the user who has to hold a proper eye position and simultaneously focus on the rear sight, the front sight, a target at different distances, and align all three planes of focus. However, such iron sights provide no information regarding distance to the target. Although advanced optical sights may provide range information, the cost of such sights is often prohibitive or useless for erratically moving targets.

It is the general practice in designing guns, particularly hand guns, to locate sighting devices on the gun barrel at both the front and the rear ends of the gun. The rear sight cooperates with the forward sight for aligning the line of fire of the gun for accurate marksmanship. It is generally desirable to provide means for adjusting the elevation and lateral positions of the rear sight and various sights have been designed for this purpose. Adjustments of this kind enable the marksman to adjust for accurate firing of the hand gun. Of course, accuracy can be improved with optical sights, laser targeting and other aids.

However, in many situations optical apparatus may interfere with the intended purpose of the user of the firearm. A conventional iron sight on a firearm provides for accurately pointing the gun in the exact direction of the target. However, with moving targets such as birds, etc., it is necessary for a marksman or hunter to develop a great deal of skill in sighting the target with the gun sight as it moves and to accurately shoot at the target as it moves. Acquiring and shooting a moving target may be part of such recreational activities as trap shooting or game bird hunting. However, moving targets could also be assailants. When a moving target is an assailant and the user is law enforcement officer or a private citizen who is defending an attack made by the assailant, it is important to for the user to rapidly and accurately acquire the target and fire when the target is in range of the user. When one considers the anxiety produced by an assailant, it is difficult even for experienced users to quickly judge distance and properly aim the handgun to target and disable the assailant.

SUMMARY

The invention is a gun sight for a firearm such as a shotgun, rifle or pistol. In one embodiment the invention is adapted for a shotgun with a ventilated rib. The invention includes a front sight having a light pipe and a rear sight having an annular (circular, oval, rectangular) compass ring including at least four compass points. The gun sight allows the user to target a gun on an object and provides a range indication to the target and enables leading a moving target. For a shotgun with ventilating rib, a front sight is mounted to the front or discharge end of a ventilating rib and the rear sight is mounted at the rear of the ventilating rib. The rear sight has a mounting mechanism that adapts to different widths of ventilating ribs and allows the rear sight to be moved forward or backward and left and right on the ventilating rib in order to center the gun sight on the target. To this end, the rear sight is a closed sight with one opening corresponding to the effective range of the firearm.

For a handgun, the front sight may be slightly slanted down from the user and carry a front light pipe. The rear sight is a closed, round sight with a compass ring having four main points and light pipes at outside the ring and located at 90 and 270 degrees. The size of the opening in the rear sight provides range information and the light pipes assist the user to rapidly align and fire against an assailant.

DETAILED DESCRIPTION

A shotgun is a firearm that is usually designed to be fired from the shoulder, which uses the energy of a fixed shell to fire a number of small spherical pellets called shot, or a solid projectile called a slug. Shotguns come in a wide variety of sizes, ranging from 5.5 mm (0.22 inch) bore up to 5 cm (2 inch) bore, and in a range of firearm operating mechanisms, including breech loading, single-barreled, double or combination gun, pump-action, bolt-, and lever-action, semi-automatic, and even fully automatic variants.

A shotgun is generally a smoothbore firearm, which means that the inside of the barrel is not rifled. The shot pellets from a shotgun spread upon leaving the barrel, and the power of the burning charge is divided among the pellets, which means that the energy of any one ball of shot is fairly low. In a hunting context, this makes shotguns useful primarily for hunting birds and other small game. However, in a military or law enforcement context, the large number of projectiles makes the shotgun useful as a close quarters combat weapon or a defensive weapon. Shotguns are also used for target shooting sports such as skeet, trap, and sporting clays. These involve shooting clay disks, known as clay pigeons, thrown in various ways. Shotguns have one or two barrels and the dual barrels may be side-by-side or one over the other (over-and-under). Many shotguns have ventilated ribs disposed along the length of the barrel. The barrel heats up when the weapon is fired, and the sights become off center or misaligned with each other. The ventilated rib is a bridge supported on bases fixed to the barrel. The sights are on the bridge. The air under the rib cools the bridge to keep the sights centered and aligned.

A handgun is a firearm designed to be held, in either one or both hands. This characteristic differentiates handguns as a general class of firearms from long guns such as rifles and shotguns (which are mounted against the shoulder). Major handgun subtypes are the revolver and pistol; other subtypes include derringers, single-shot pistols, semi-automatic pistols, pepperboxes, and machine pistols. Users often distinguish revolvers from pistols. Often handgun experts make a technical distinction that views pistols as a subset of handguns. Sometimes in American usage, the term "pistol" refers to a handgun having one chamber integral with the barrel, making pistols distinct from the other main type of handgun, the revolver, which has a revolving cylinder containing multiple chambers.

Figure 1:
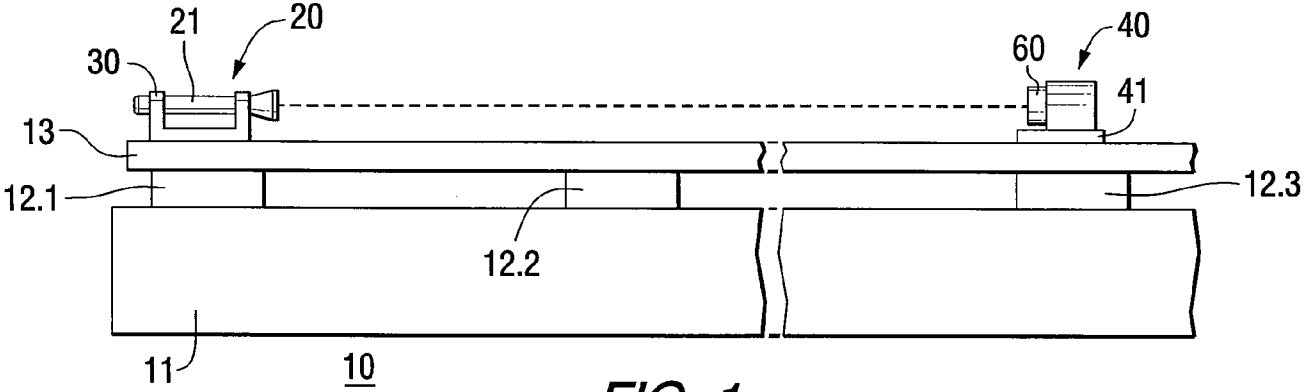
FIG. 1 is a partial elevation view of the invention mounted on a ventilating rib on a barrel of the shotgun.

Turning to FIG. 1, there is shown a barrel 11 of a shotgun. The top of the barrel has a ventilating rib (bridge) 13 supported by rib bases 12.1, 12.2 and 12.3. The base 12.1 is near the discharge opening of the barrel and base 12.3 is at the other, loading end of the barrel proximate the user. A front sight 20 is mounted on the distal end of the rib and a rear sight 40 is on the end of the rib proximate the user. The front sight 20 has a sight support 30 that holds a light pipe 21. The rear sight 40 has, in one embodiment, a rear support 41 that supports a compass ring 60. The light pipe may be made of translucent optical fiber and colored green or orange with a fluorescent dye. The compass ring 60 is made of a polycarbonate thermoplastic resin, such as Lexan® brand plastic. It is also colored green or orange with a fluorescent dye. In order to provide contrast, the light pipe and the compass rings have different colors. The compass ring 60 has four points extending inward at locations of 0, 90, 180 and 270 degrees. In operation, a hunter will adjust the barrel of the gun to position the front of the light pipe (21) in the center of the compass ring 60 using the compass points as guides.

Turning to FIGS. 2A-2D, the light pipe 21 has elongated cylindrical body 24 terminated at a proximal, conical end 22 and a distal, flat end 25. A raised key 23 on the cylindrical body 24 keeps light pipe fixed in place in the front sight support 30. Turning to FIGS. 3A-3D, the front support 30 has a base 27 with alignment bearings 28, 31 at opposite ends. Between the ends, base 27 has an aperture 33 for receiving a fixing screw that holds the base 27 on the ventilating rib 13. The alignment bearing 28 has an aperture 29 with a keyway 30. Alignment bearing 31 has as an aperture 32. Alignment bearing 28 faces the user. The light pipe 21 is inserted into the aperture 29 using the keyway 30 in the bearing and the key 23 on the light pipe to guide to pipe to aperture 32 in distal bearing 31. After the light pipe 21 is positioned between the apertures 29, 32, the light pipe 21 is rotated in order to move the key 23 out of the keyway 30 and bear against the surface of the alignment bearing member 28 that faced member 31.

Turning to FIGS. 4A-4D there are shown details of the rear sight support 40. It has a base 41 that defines a circular aperture 42 having a half circle cylindrical top portion 49. The base 41 has four mounting holes, 43, 44, 45, 46. The mounting holes are elongated in order to allow the rear support 40 to be positioned left or right on the ventilating rib 13. Mounting holes 43-46 receive mounting screws.

Figure 5:
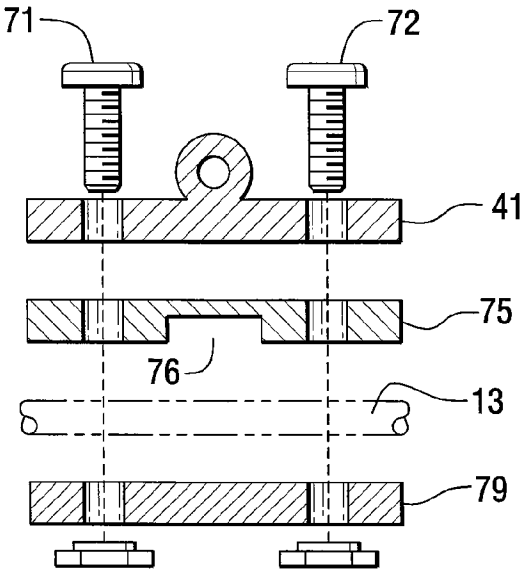
FIG. 5 shows an adjustment mechanism for the rear sight.
Figure 7A:
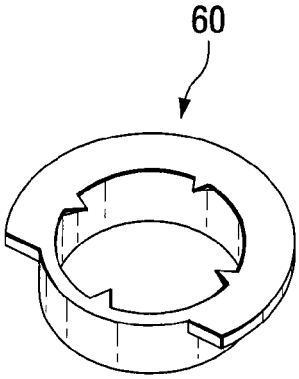
FIG. 7A is a perspective view of the circular compass ring.

Rear sight 40 is mounted on the ventilating rib 13 using the mounting structures shown in FIG. 5. A bracket 79 is disposed below the rib 13. A rib base 75 has a notch 76 wider than the width of the rib for fitting over the rib 13. In practice, a manufacturer may supply a set a front and rear sights with a multiple rib bases to provide the user with enough bases to fit the different width ribs of different shotguns. The rear sight base 41 is disposed over the rib base 75. Four screws including screws 71, 72 are threaded into openings in the sight base 41, the rib base 75 and the bracket 76. The notch 76 allows the users to slide the assembled rear sight 40 fore and aft on the rib 13 for range and the elongated holes 43-46 in the rear base 41 allows left and right adjustment for centering and windage. FIG. 7A shows a circular ring 60 made from polycarbonate thermoplastic resin, such as Lexan® brand plastic. It has four compass points at 0, 90, 180 and 270 degrees. Ring 60 fits into the distal end of circular opening 42.

Figure 7B:
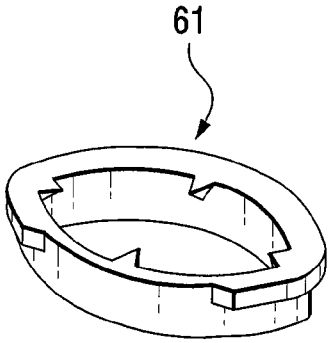
FIG. 7B is a perspective view of the oval compass ring.

An alternate rear support 50 is shown in FIGS. 6A-6D. The rear sight support 50 has a base 51 that defines an oval circular aperture 52 having a half oval top portion 59. The base 51 has four mounting holes, 53-56. The mounting holes are elongated in order to allow the rear support 50 to be position left or right on the ventilating rib 13. Mounting holes 43-46 receive mounting screws, such as screws 71, 72 shown in FIG. 5. FIG. 7B shows an oval ring 62 made from polycarbonate thermoplastic resin, such as Lexan® brand plastic. It has four compass points at 0, 90, 180 and 270 degrees. Ring 62 fits into the distal end of oval opening 52.

The gun sight of the invention, when adjusted, also provide range information to the user. For example, the circular rear sight 40 is set up by the user to enclose an exemplary shot pattern at a predetermined distance from the hunter. For example, a preferred range of 35 yards is a typical range for a employing a shotgun to hunt turkeys. At that range, a shot pattern will have a small enough spread at the distance of 35 yards to mostly impact the head and neck of the turkey and leave the body of the turkey free from shot. In a similar manner, the oval rear sight 50 has a width that corresponds to the wing spread of a flying duck or goose and a height corresponding to the distance between the head and feet of a duck or goose. The 90 degree or 270 degree point can be used to lead the target.

As explained above, the invention may also be adapted to embodiments attached to handguns. Such embodiments provider the user with range and aiming information to enable the user to quickly and accurately acquire an adverse target. More specifically a rectangular rear sight is provided for self defense. The relatively large rectangular opening is designed to frame a potential assailant and is wide enough to allow the user to employ both eyes to frame the target in the sight.

Figure 7C:
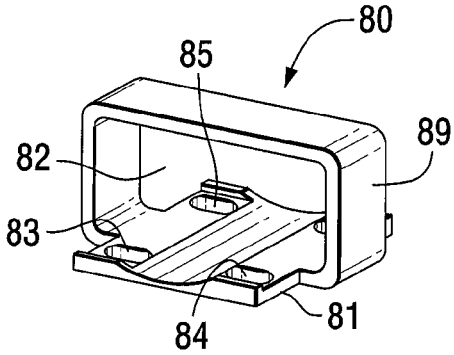
FIG. 7C is a perspective view of a rear sight for a handgun.
Figure 7D:
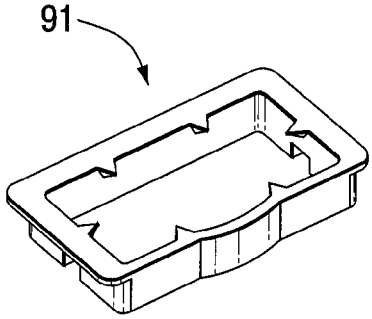
FIG. 7D is a perspective view of a ring for the rear sight with compass points.
Figure 7E:
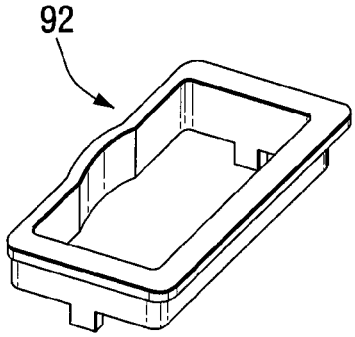
FIG. 7E is a perspective view of the ring for the rear sight without compass points.
Figure 8B:
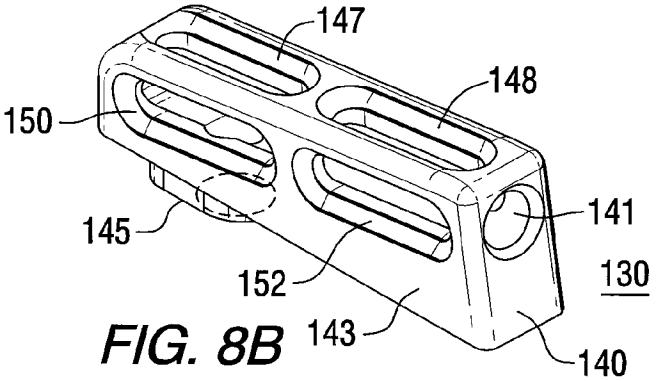
FIG. 8B is perspective view of the front sight.
Figure 8D:
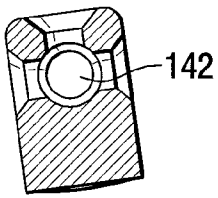
FIG. 8D is a sectional view taken along the line 8D-8D of FIG. 8C.
Figure 8A:
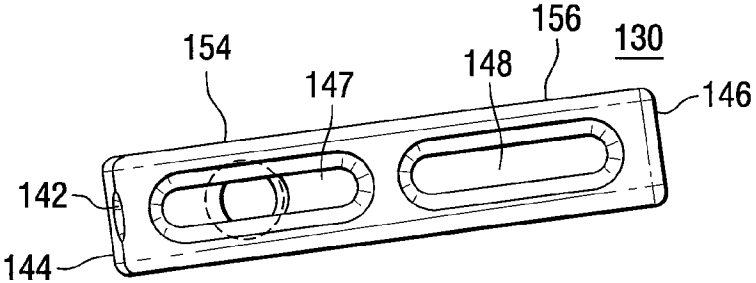
FIG. 8A is a top plan view of a front sight for a handgun.
Figure 8C:
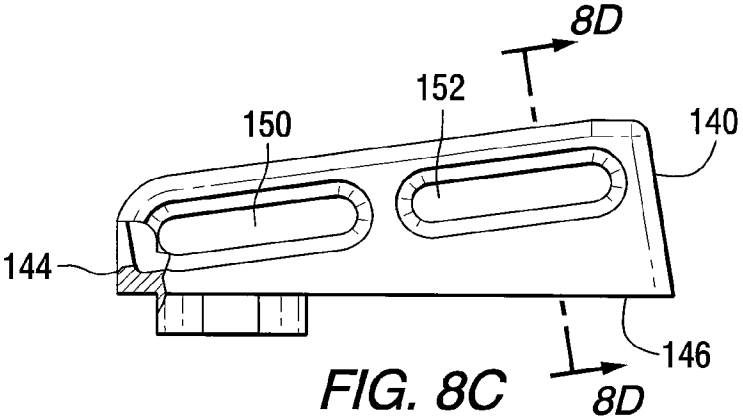
FIG. 8C is an elevation view of the front sight.
Figure 8E:
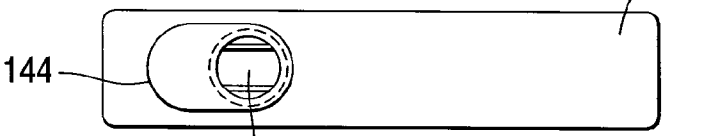
FIG. 8E is bottom plan view of the front sight of FIG. 8A.

One rectangular handgun rear sight is 80 is shown in FIGS. 7C. The rear sight 80 has a base 81 that defines a rectangular aperture 82 having a half rectangular top portion 89. The base 81 has four mounting holes, 83-86. The mounting holes are elongated in order to allow the rear support 80 to be position left or right on the ventilating rib 13. Mounting holes 83-86 receive mounting screws, such as screws 71, 72 shown in FIG. 5. FIGS. 7D and 7E show rectangular rings polycarbonate thermoplastic resin, such as Lexan® brand plastic. Ring 91 has six compass points: lateral points are at 90 and 270 degrees. Four other points are disposed at about 30, 120, 240 and 310 along the top and bottom edges of the ring. Ring 91 fits into the distal end of opening 82 and ring 92 fits into the proximate end of the opening 82. The rectangular opening is sized so that when user fills the frame with the torso or other body portion of the assailant, the assailant is considered to be within an accurate range of the handgun, e.g. 25 feet.

Figure 2A:
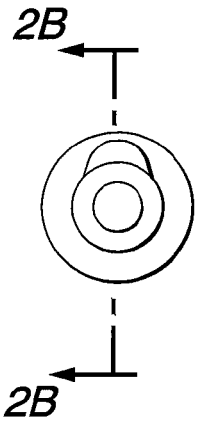
FIG. 2A is an end view of the front sight.
Figure 2B:
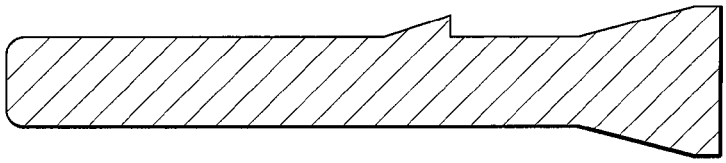
FIG. 2B is a sectional view of the front sight of FIG. 2A taken along the line 2B-2B.
Figure 2C:
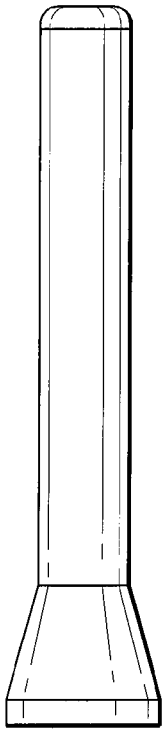
FIG. 2C is an elevation view of the front sight.
Figure 2D:
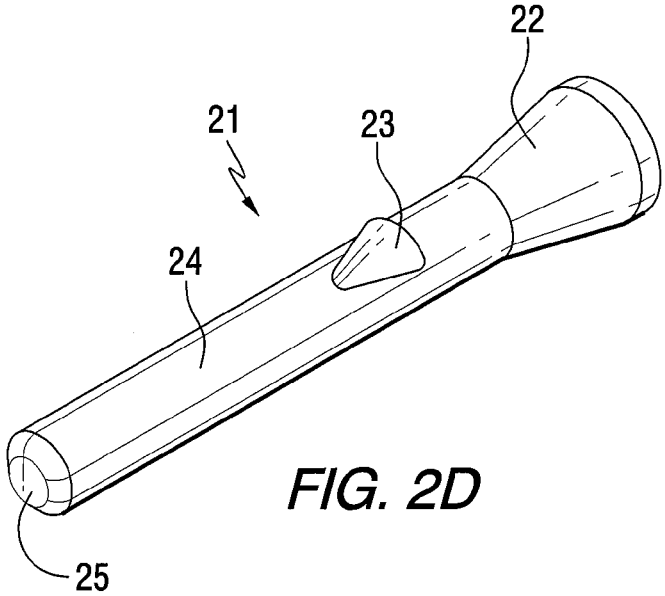
FIG. 2D is a perspective view of the front sight of FIG. 2A.
Figure 3A:
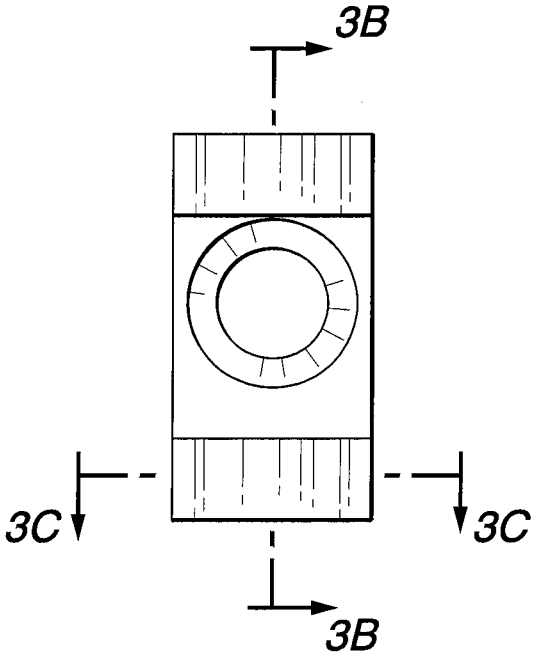
FIG. 3A is a plan view of the front sight alignment bearing.
Figure 3B:
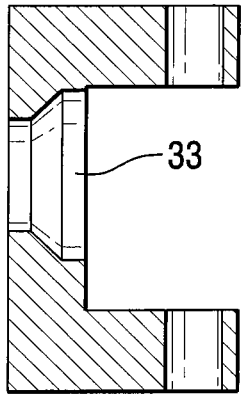
FIG. 3B is a longitudinal sectional view of the front sight alignment bearing taken along the line 3B-3B of FIG. 3A.
Figure 3C:
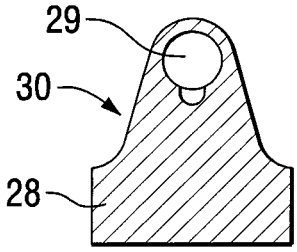
FIG. 3C is an elevation sectional view of the front sight alignment bearing taken along the line 3C-3C of FIG. 3A.
Figure 3D:
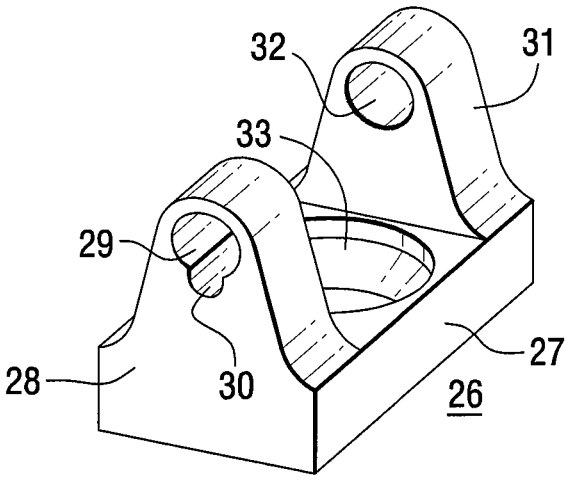
FIG. 3D is a perspective view of the front sight alignment bearing of FIG. 3A.
Figure 4A:
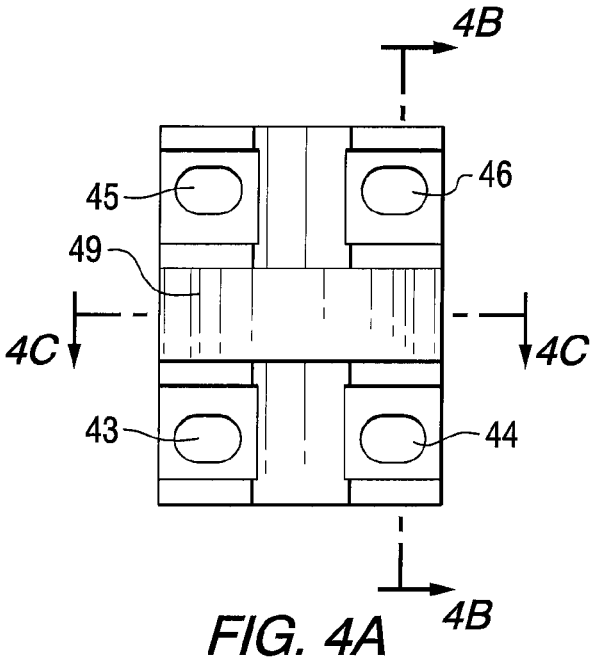
FIG. 4A is a plan view of the circular rear sight.
Figure 4B:
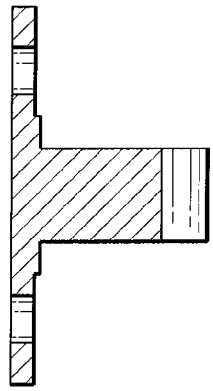
FIG. 4B is a longitudinal sectional view of the circular rear sight taken along the line 4B-4B of FIG. 4A.
Figure 4C:
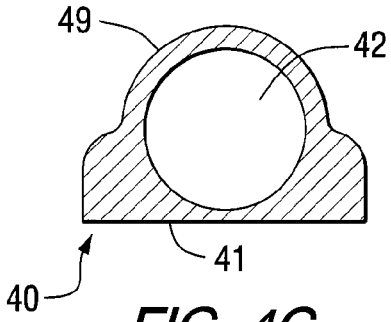
FIG. 4C is an elevation sectional view of the circular rear sight taken along the line 4C-4C of FIG. 4A.
Figure 4D:
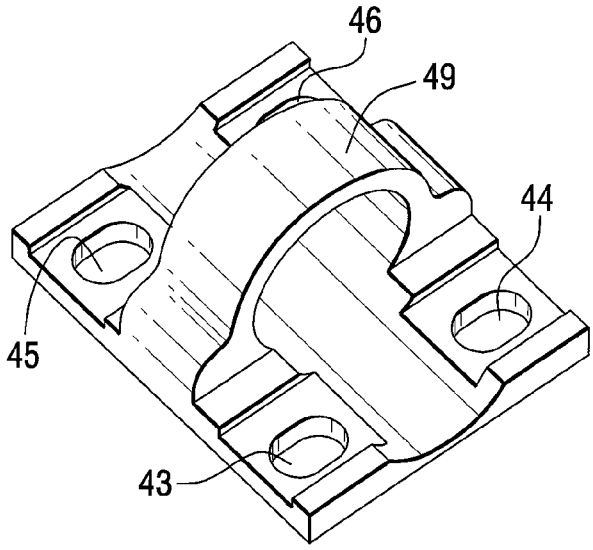
FIG. 4D is a perspective view of the circular rear sight of FIG. 4A.
Figure 6A:
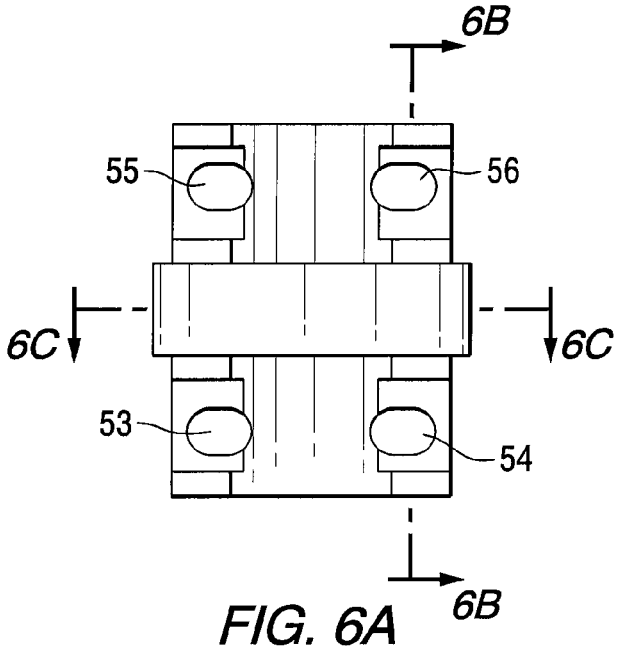
FIG. 6A is a plan view of the annular oval rear sight.
Figure 6B:
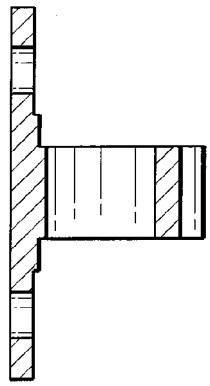
FIG. 6B is a longitudinal sectional view of the annular oval rear sight taken along the line 6B-6B of FIG. 6A.
Figure 6C:
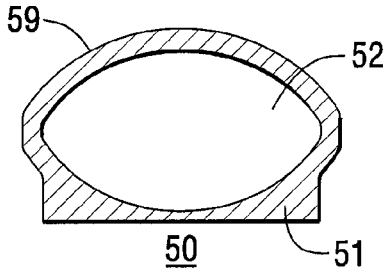
FIG. 6C is an elevation sectional view of the annular oval rear sight taken along the line 6C-6C of FIG. 6A.
Figure 6D:
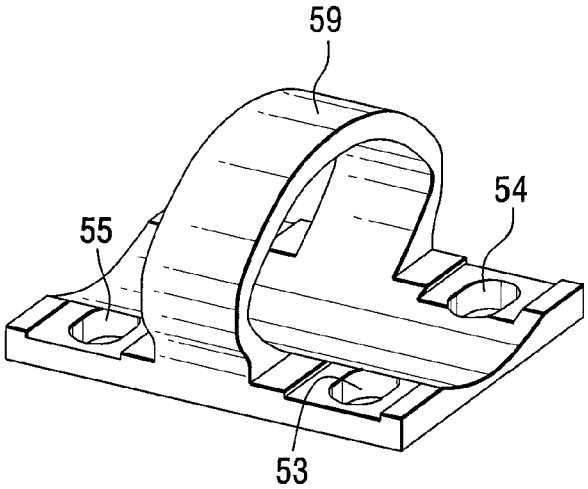
FIG. 6D is a perspective view of the annular oval rear sight of FIG. 6A.

FIGS. 8A-8E, 9A-9E show an alternate handgun sight including a front sight 140 and rear sight 130, respectively. The front sight 140 has an elongated, rectangular body with one flat surface 141 at one end that faces the user and another flat surface 144 facing the target. A light pipe, such light pipe 21 shown in FIG. 2C-2D, is inserted into the open space between the rear opening 141 and forward opening 142. The body of the sight 140 has top and side windows 147, 148, 150, 152, 154, 156 to admit light in order to fluoresce the light pipe 21. The base 146 of the body is angled at a depending angle of approximately 8 degrees. The body is angled to allow the user to holster the handgun without catching on the holster, the rounded corer of the front sight slips easily into a holster. An aperture 155 in the base admits a set screw for fixing the front sight 140 to the discharge end of the handgun.

Figure 9C:
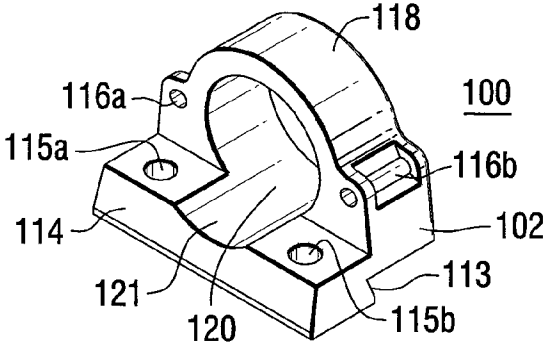
FIG. 9C is a perspective view of the rear sight of FIG. 9A from an opposite angle.
Figure 9B:
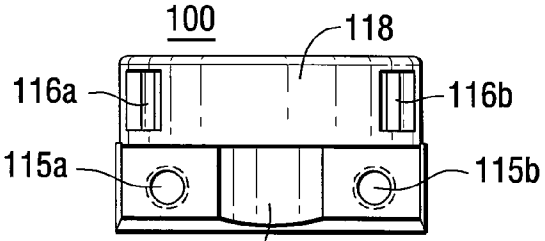
FIG. 9B is a plan view of the rear sight of FIG. 9A.
Figure 9E:
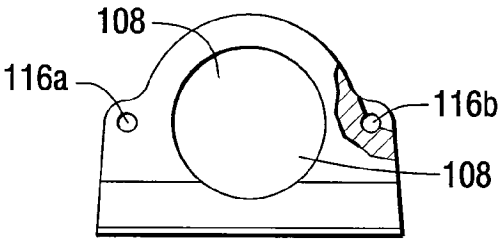
FIG. 9E is a longitudinal view of the rear sight of FIG. 9A.
Figure 9A:
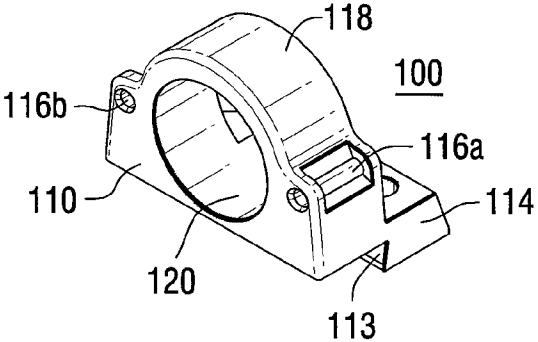
FIG. 9A is a perspective view of a rear sight from one angle.
Figure 9D:
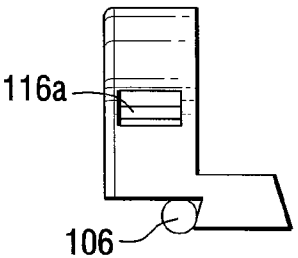
FIG. 9D is an end view of the rear sight of FIG. 9A partially broken away at the on light pipe.

The rear handgun sight 120 a body 102 with a circular opening for centering the target and a dovetail 114 for fixing the sight to the rear of the handgun. The configuration of the dovetail 114 will change depending upon the manufacturer of the handgun. In the embodiment shown in this application the dovetail 114 is modified to fit a handgun made by Glock. The rear gun sight 120 is configured to have the opening stepped back as shown in FIG. 9A so that surface 110 of the body 102 faces the user.

The circular opening is defined by an upper portion with a curved top surface 118 and a lower portion with a tongue section 121 that has the same radius of curvature as the opening and extends over the top of the center of the dovetail 114. The rear sight 120 has a step 113 between the bottom of the aperture support body 102 and the dovetail 114. A compass ring such as ring 60 shown in FIG. 7A fits into the opening. The compass ring 60 is made from polycarbonate thermoplastic resin, such as Lexan® brand plastic. It has four compass points at 0, 90, 180 and 270 degrees. Ring 60 fits into the distal end of circular opening. The ring is colored with a fluorescent dye, preferably a red dye if the light pipe 21 is green or vice versa. The sight 120 has a pair of green fluorescent dyed light pipes 116*a*, 116*b* arranged on opposite sides of the diameter of the circular opening. The light pipes 116*a*, 116*b* are aligned with the 90 degree and 270 degree compass points and establish an imaginary line across the middle of the opening. The front sight 120 has a dovetail base 114 that fits into a recess in the top of a handgun. For example, pistols have conventional rear sights that are have dovetails which pressure fit into openings in the tops of the slide. However, a gunsmith, with the appropriate tools, may remove the original rear sight and insert the new rear sight 120 into the space provided in the slide. The dovetail 114 has apertures 115*a*, 115*b* for receiving screws which can engage recessed threads in the slide to fix the dovetail in place. In other words, if the dovetail receptacle in the slide or top of the revolver is miss-sized, the screws will engage and pull the sight into place. In fact, the rear sight 120 is so firmly fixed in place that it can be used by law enforcement officers to cock their handgun by pressing the rear sight onto the edge of a holster or belt and forcing the body of the slide down to chamber and/or cock the trigger. In a similar manner, the user may manipulate the slide to unlock a jammed round by tugging on the rear sight or hammering the rear sight against a fixed object to free up the slide.

To aim at a target, the user orients the front, green light pipe 21 to sit in middle of the imaginary line established by the rear sight light pipes 116*a*, 116*b* and the compass points. The aim is deemed centered when the from green light is brought to the center of the circle of the rear sight. Centering is achieved using the compass points and the rear green lights to establish an imaginary line across the center of the circle. The closer the user positions the front green light in the center of the circle, the tighter the firing cluster of the bullets in the profile. The user will adjust the position of the center green light relative to the left and right rear lights 116*a*, 116*b* and the 0 and 180 degree compass points in order to account of the user's aiming characteristics and the inherent firing peculiarities of the handgun and the interaction between the user and the handgun during firing. A user may shoot high or low, left or right. However, once the user knows his/her characteristics (or the peculiarities of the handgun) the user may adjust his/her aim accordingly. Such characteristics and peculiarities are established at a firing range where the user centers a number of trial shots on a target, observes the variation in the location of the target hits to the aimed location indicated in the gun sight, and adjust for the user's aiming characteristics and the handgun's firing peculiarities and the interaction between the two.

In one embodiment the diameter of the opening in the rear sight is about 0.418+001 inches. That opening is sized to provide the user with range information. More specifically, when a profile of a target or an assailant fills the opening between the compass points of 90 and 270 degrees, the profile of the target is in range of a accurate shot. The range is approximately 25 feet. In other words, if the user fills the opening between the 90 and 270 compass points with a target profile, then the target is with a range of 25 feet. Stated another way, if the user sees shoulder-to-shoulder inside the rear circle, the assailant is likely within 25 feet of the user. If the handgun is then aimed to align the target profile with the imaginary line made by the light pipes, there is a very high likelihood the handgun with discharge a round that will strike the profile of the target.

The method for adjusting the sights to provide accurate targeting of shotgun with a ventilated rib is as follows. As first step, the user fixes the front sight on the discharge or distal end of the rib and fixes the rear sight at a first location on the end of the rib proximate the user. The user selects a reasonable target range, such as 35 yards, and places a target such as a full size image of turkey with a raised head at that location. The rear sight is set to a first location and the user fires a pattern at the target by positioning the image of the turkey's head between the 0 and 180 points of the compass ring. The user centers the turkey head between the opposite compass points, fires, and then inspects the pattern. If the pattern of shot is tight around the image of the turkey head, no further adjustment is required. However, if the pattern indicates shot entering the image of the turkey's body, then the rear sight is adjusted to improve the shot pattern. Moving the rear sight forward will make the shot pattern tighter and moving the rear sight backward with widen the shot pattern. The steps may be repeated until the rear sight is set to a pattern acceptable to the user. During actual hunting, the user may quickly acquire the target of a turkey and know that if the head of the turkey is touching or beyond the 0 and 180 points, the turkey is at a range of 35 yards and thus close enough to shot at and expect a tight shot pattern. The setting for in flight game birds is similar, but uses compass points 0 and 180 for the head and fee and 90 and 270 for the wing spread.

Adjusting sights for handguns is slightly different. The target distance for a handgun is, for example, 25 feet. Other distances may be selected depending upon the experience and skill of the user and the inherent accuracy of the handgun. The user sets a target that corresponds to a shoulder-to-shoulder profile of the assailant and stands the selected and presumed accurate distance of 25 feet from the target and fires a number of rounds to provide a pattern on the target. In order to target the profile, the user selects the 90 and 270 compass points so that the test target's shoulder-to-should profile is between or beyond both points. To assist the user, the rear sight has left and right light pipes disposed at the 90 and 270 degree location in the annular body of the rear sight and aligned with the compass points. Thus, the front site is targeted in the middle of the imaginary line between the 90 and 270 degree points and thus in the center of a shoulder-to-shoulder profile. If the boundary of the target far inside the 90 and 270 compass points, the assailant may be too distant for an accurate shot. Depending upon the tightness of the pattern, the user may alter the location of the rear sight or move closer to the target to fill the rear sight left to right with the shoulder-to-shoulder profile. If the rear sight is not adjustable, the user practices until the user can provide a tight pattern inside the 90 and 270 compass points or find suitable ranges where the shoulder-to-shoulder profile relative to the rear site provides a tight pattern at known range.

In summary, the gun sights of the invention provide range and alignment information without the cost of expensive ranger finders and optical gun sights. It also enables rapid eye-to-target acquisition which is especially important when the user is under assault and time is of the essence.

The gun sight of the invention is not limited to the exemplary embodiments show above. The front and read sights may be mounted on any shotgun, rifle or pistol. The sights may be permanently mounted by drilling holes in the barrel of the weapon, machining the opening to have a screw thread, and then screwing the sights into the machined openings. Other methods of mounting include using spring mounts and high temperature adhesives.

The invention claimed is:

1. A pair of sights for a firearm comprising:

a front sight comprising an elongated base with a body for receiving and holding a light pipe and a light pipe colored with a fluorescent dye disposed in said body of said front sight; and a rear sight comprising a body with a base and an annular closed sight having an inside diameter and a compass ring disposed in said diameter and having a plurality of compass points, said compass ring comprising translucent material colored with a fluorescent dye and said inside diameter defining an opening which corresponds to an effective range of the firearm for a target whose image is substantially bounded by two or more points of the compass ring.

2. The pair of sights of claim 1 wherein the color of the dye of the light pipe contrasts with from the color of the dye of the compass ring.

3. The pair of sights of claim 1 wherein the front sight body is elongated and has front and rear bearings for receiving and holding the light.

4. The pair of sights of claim 3 wherein the rear sight defines a circular closed ring, the annular compass ring has points at 0, 90, 180 and 270 degrees.

5. The pair of sights of claim 1 wherein the rear sight defines an oval closed ring and an annular, oval compass ring has points at 0, 90, 180 and 270 degrees.

6. The pair of sights of claim 1 wherein the front sight body is elongated with end walls, has a slanted base to provide a rear end higher than its front end, one or more apertures in the body to admit light, an a light pipe supported between the ends of the front sight by apertures in the end walls for receiving and supporting the light pipe.

7. The pair of sights of claim 6 wherein the rear sight defines a circular closed ring, the annular compass ring has points at 0, 90, 180 and 270 degrees and has a pair of light pipes disposed in the body of the closed ring at locations corresponding to the 90 and 270 degree points of the compass.

8. The pair of sights of claim 7 wherein the inside diameter of the read sight closed ring is 0.42 inches.

9. The pair of sights of claim 6 wherein the rear sight defines a rectangular closed ring and a rectangular compass ring with compass points at 30, 90, 120, 180, 240 and 310 degrees.

10. A method for applying sights to an elongated barrel of a firearm, the elongated barrel having a distal end for discharging a round and proximate end near the user, the sights for aiming and ranging the firearm on a target, comprising:

fixing a front sight on the distal end of the barrel;

providing a first light pipe in the front sight, the first light pipe comprising a translucent material having a fluorescent dye;

providing a rear sight on the proximate end of the barrel, the rear sight defining a closed ring;

providing an annular compass ring on the rear sight, the annular compass ring comprising a translucent material with fluorescent dye;

adjusting the position of the rear sight relative to the front sight until a boundary of a predetermined target is centered inside the closed rear sight and a predetermined boundary region of the target is proximate at least two opposing compass points.

11. The method of claim 10 wherein the step of adjusting the rear sight comprises the steps of:

fixing the rear sight at a first location;

providing a target with a predetermined boundary;

placing a test target a predetermined distance from the user;

firing one or more rounds at the test target to establish a test pattern of test target hits indicative of the accuracy of the sights at the predetermined distance; and iteratively moving the rear sight relative to its first location to a second or subsequent location to improve the accuracy or grouping of the test pattern and thereby establish the range to an actual target as the predetermined distance to the test target when the rear sight is adjusted to place the opposite compass points on the portions of the boundary of the test target.

12. The method of claim 10 wherein the rear sight defines a circular closed ring, the annular compass ring has points at 0, 90, 180 and 270 degrees, the predetermined target is a turkey and the predetermined boundary region of the target is the turkey's head located between the 0 and 180 degree points.

13. The method of claim 12 wherein the range to the turkey is 35 yards.

14. The method of claim 10 wherein the rear sight defines an oval closed ring, the annular compass ring has points at 0, 90, 180 and 270 degrees, the predetermined target is a game bird in flight and the boundary region of the target is the wingspread of the game bird between the 90 and 270 compass points and the head and feet between the 0 and 180 compass points.

15. The method of claim 14 wherein the range to the game bird is 35 yards.

16. The method of claim 10 wherein the rear sight defines a circular closed ring, the annular compass ring has points at 0, 90, 180 and 270 degrees, the predetermined target is an assailant and the predetermined boundary region of the target is the shoulder width of the assailant located between the 90 and 270 degree points.

17. The method of claim 16 wherein the range to the target is 25 feet.

* * * * *

UNITED STATES PATENT AND TRADEMARK OFFICE

CERTIFICATE OF CORRECTION

PATENT NO. : 8,739,454 B2
APPLICATION NO. : 13/665309
DATED : June 3, 2014
INVENTOR(S) : Jesse Erdle, Mike Furia and Kristian Meyer It is certified that error appears in the above-identified patent and that said Letters Patent is hereby corrected as shown below:

Title page, item (72)

Replace inventor "Mike Furla"

with

-- Mike Furia --.

Signed and Sealed this
Twenty-seventh Day of January, 2015

Michelle K. Lee

Michelle K. Lee
*Deputy Director of the United States Patent and Trademark Office*